US009511965B2

(12) United States Patent
Hatano et al.

(10) Patent No.: US 9,511,965 B2
(45) Date of Patent: Dec. 6, 2016

(54) COUNTER EJECTOR AND BOX FORMER

(75) Inventors: Osamu Hatano, Mihara (JP); Toshiaki Miyakura, Mihara (JP); Shinya Iori, Mihara (JP)

(73) Assignee: MITSUBISHI HEAVY INDUSTRIES PRINTING & PACKAGING MACHINERY, LTD., Mihara-Shi, Hiroshima (JP)

( * ) Notice: Subject to any disclaimer, the term of this patent is extended or adjusted under 35 U.S.C. 154(b) by 788 days.

(21) Appl. No.: 13/880,284

(22) PCT Filed: Jan. 26, 2012

(86) PCT No.: PCT/JP2012/051632

§ 371 (c)(1),
(2), (4) Date: May 21, 2013

(87) PCT Pub. No.: WO2012/105402

PCT Pub. Date: Aug. 9, 2012

(65) Prior Publication Data

US 2014/0148321 A1 May 29, 2014

(30) Foreign Application Priority Data

Jan. 31, 2011 (JP) ..... 2011-017588

(51) Int. Cl.
*B65H 5/22* (2006.01)
*B65H 29/24* (2006.01)
(Continued)

(52) U.S. Cl.
CPC ..... *B65H 5/228* (2013.01); *B31B 1/00* (2013.01); *B31B 7/00* (2013.01); *B65H 3/08* (2013.01);
(Continued)

(58) Field of Classification Search
CPC ..... B65H 5/228; B65H 3/08; B65H 31/20; B65H 33/00; B65H 31/04; B65H 31/08; B65H 31/10; B65H 2406/12; B65H 2406/14; B65H 2405/11164; B65H 2405/1122; B65H 2406/121; B65H 2511/20; B65H 2701/1764; B31B 1/00; B31B 7/00; B31B 2201/0241; B31B 2201/027; B31B 2201/927
USPC ..... 493/56
See application file for complete search history.

(56) References Cited

U.S. PATENT DOCUMENTS 4,033,579 A * 7/1977 Stange ..... B65H 3/34 271/195
4,311,475 A * 1/1982 Imai ..... B42C 19/08 271/218

(Continued)

FOREIGN PATENT DOCUMENTS

CN 101784468 A 7/2010
JP S59-28507 B2 7/1984

(Continued)

OTHER PUBLICATIONS

China Patent Office, "Office Action for CN 201280003526.4", Dec. 30, 2013.

(Continued)

*Primary Examiner* — Sameh Tawfik
(74) *Attorney, Agent, or Firm* — Manabu Kanesaka; Benjamin Hauptman; Kenneth Berner

(57) ABSTRACT

A counter ejector disposed at a downstream part of a box former, the counter ejector including a hopper that receives a sheet-shaped corrugated board box being transferred from an upstream side and fallen; and a blower that downwardly blows air to a hopper from above the corrugated board box, wherein the blower is capable of changing a blowing area to be blown along a transfer direction of the corrugated board box, and blows air to the blowing area corresponding to at least the front-end portion and the rear-end portion of the hopper in the transfer direction if the corrugated board box has a possible maximum size in the transfer direction.

16 Claims, 11 Drawing Sheets

(51) Int. Cl.

| | |
|---|---|
| ***B65H 31/20*** | (2006.01) |
| ***B65H 33/00*** | (2006.01) |
| ***B31B 1/00*** | (2006.01) |
| ***B31B 7/00*** | (2006.01) |
| ***B65H 3/08*** | (2006.01) |

(52) U.S. Cl.

CPC ..... *B65H 29/247* (2013.01); *B65H 31/20* (2013.01); *B65H 33/00* (2013.01); *B31B 2201/027* (2013.01); *B31B 2201/0241* (2013.01); *B31B 2201/927* (2013.01); *B65H 2406/121* (2013.01); *B65H 2511/20* (2013.01); *B65H 2701/1764* (2013.01)

(56) References Cited

U.S. PATENT DOCUMENTS

| | | | | | |
|---|---|---|---|---|---|
| 4,395,038 | A | | 7/1983 | Fitzpatrick et al. | |
| 4,500,243 | A | * | 2/1985 | Ward, Jr. | B65H 31/18 271/197 |
| 4,643,414 | A | * | 2/1987 | Weisgerber | B65H 29/041 271/183 |
| 4,702,468 | A | * | 10/1987 | Pollich | B65H 29/247 271/195 |
| 5,493,104 | A | | 2/1996 | Wilson | |
| 5,671,918 | A | * | 9/1997 | Hofmann | B65H 29/247 271/182 |
| 6,027,440 | A | * | 2/2000 | Roth | B31B 1/04 493/436 |
| 6,032,923 | A | * | 3/2000 | Biegelsen | B65H 5/228 137/599.07 |
| 7,007,940 | B2 | * | 3/2006 | Polidoro | B65H 3/08 271/11 |
| 7,140,606 | B2 | * | 11/2006 | Suga | B65H 3/48 271/97 |
| 8,480,550 | B2 | * | 7/2013 | Taketsugu | B31B 1/74 493/12 |
| 2009/0166958 | A1 | * | 7/2009 | Miwa | B65H 29/041 271/207 |
| 2010/0190626 | A1 | * | 7/2010 | Taketsugu | B31B 1/98 493/56 |

FOREIGN PATENT DOCUMENTS

| | | | |
|---|---|---|---|
| JP | 2005-179002 | A | 7/2005 |
| JP | 2007-261804 | A | 10/2007 |
| JP | 2008-149730 | A | 7/2008 |

OTHER PUBLICATIONS

Japan Patent Office, "Information Statement for JP 2011-017588," Dec. 25, 2012.

Japan Patent Office, "Decision to Grant a Patent for JP 2011-017588," Jun. 2, 2015.

* cited by examiner

COUNTER EJECTOR AND BOX FORMER

CROSS-REFERENCE TO RELATED APPLICATIONS

The present application is National Phase of International Application No. PCT/JP2012/051632 filed Jan. 26, 2012, and claims priority from Japanese Application No. 2011-017588, filed Jan. 31, 2011.

BACKGROUND OF THE INVENTION

Field of the Invention

The present invention relates to a counter ejector that is disposed at the most downstream part of a box former and that counts corrugated board boxes and ejects the corrugated board boxes in batches, and a box former using the counter ejector thereof.

Description of Related Art

A box former that manufactures corrugated board boxes includes a counter ejector that counts manufactured corrugated board boxes at the most downstream part of the box former and ejects the corrugated board boxes piled in batches each containing a predetermined number of boxes.

Recently, the speed of manufacturing in the box former has been increased, which has arisen a demand for increasing the processing speed of the counter ejector. In view of the above, there have been proposed various techniques related to the counter ejector.

For example, Patent Literature 1 discloses a counter ejector having the configuration illustrated in FIGS. 10(*a*)-10(*c*). As illustrated in FIG. 10(*a*), the exit (the most downstream section) of a folder gluer 101 and a pair of vertically arranged forwarding rolls 102 are attached to upper stream of the counter ejector of Patent Literature 1. A spanker 111 that depresses the edge of a stack 150 is disposed at a lower portion of the forwarding rolls 102, and a front stop 126 that stops a corrugated board box 103 ejected from the folder gluer 101 and that is movable in forward and backward directions is disposed ahead (downstream) of the forwarding rolls 102.

The space between the spanker 111 and the front stop 126 is a hopper section H in which the sheet-shaped corrugated board boxes 103 are piled as the stack 150.

A support ledge 122*a* is attached to the bottom of the spanker 111 so as to go into and out of the hopper H. Furthermore, a pusher 124 that pushes the stack 150 is disposed under the support ledge 122*a* so as to go in and out. Another support ledge 122*b* is disposed at the bottom of the front stop 126 so as to go into and out of the hopper H. The support ledges 122*a* and 122*b* face each other and cooperatively receive the stack 150 on a ledge 136 to be detailed below.

An elevator 129 is disposed below the front stop 126, so that the corrugated board boxes 103 which hit the front stop 126 and fall are received and piled as the stack 150 on the elevator 129. The elevator 129 is substantially horizontally arranged slightly ahead (downstream) of the forwarding rolls 102 and is configured to be vertically movable. A blower 132 that blows air AF on the top surface of the corrugated board box 103 is disposed over the elevator 129. The position of the blower 132 is higher than that of the corrugated board box 103 forwarded from the forwarding rolls 102.

The ledge 136 is disposed opposite to and ahead (downstream) of the forwarding rolls 102. The ledge 136 is configured to be vertically movable and to go into and out of the hopper H. As illustrated in FIG. 10(*b*), the ledge 136 is activated when the corrugated board boxes 103 received on the elevator 129 and piled as the stack 150 reached a predetermined number, so as to receive corrugated board boxes 103*a* that are to be piled as a next stack 150*a*. A vertical direction member 136*a* of the ledge 136 supports a press bar 138, which depresses the stack 150 and is vertically movable by an air cylinder 139.

An ejecting conveyor 140 is disposed at the same level as the top surface of the elevator 129 when being in the lowest position and at a position sufficiently close to the pusher 124 to handle the minimum box size. When the ledge 136 is activated to receive the corrugated board boxes 103*a* that are to form the next stack 150*a*, the elevator 129 immediately starts moving down to the same level as the ejecting conveyor 140. At this time, in order to avoid collapse of the stack 150 due to spring back, the press bar 138 is depressed down from the ledge 136 and thereby the stack 150 is brought down, being sandwiched between the press bar 138 and the elevator 129. When the top surface of the stack 150 passes the support ledges 122*a* and 122*b*, the support ledges 122*a* and 122*b* project inside the hopper H and come into the stand-by state. Concurrently, the next stack 150*a* is formed on the ledge 136.

An exit conveyer 141 is disposed downstream of the ejecting conveyor 140 and an upper conveyer 144 is disposed over the exit conveyer 141. The position of the upper conveyer 144 can be adjusted both in the machine direction (i.e., the lateral direction of FIGS. 10(*a*)-10(*c*)) and the height direction. The upper conveyer 144 moves in conjunction with the front stop 126 by a predetermined distance from the front stop 126 in accordance with the size of a corrugated board box. As illustrated in FIG. 10(*c*), after the pusher 124 extrudes the stack 150 on the ejecting conveyor 140 in order for the stack 150 to be sandwiched between the ejecting conveyor 140 and the upper conveyer 144, the upper conveyer 144 brings out the stack 150 in a batch, sandwiching the stack 150 from the top and the bottom in cooperation with the ejecting conveyor 140 and the exit conveyer 141.

When the batch starts moving on the ejecting conveyor 140 as indicated by the arrow in FIG. 10(*c*), the press bar 138 slightly rises to leave the top surface of the batch and the ledge 136 evacuates in conjunction with the press bar 138 to such a position that the ledge 136 does not interfere with the stack 150*a*, waiting for the next rise. At this time, the stack 150*a* on the ledge 136 is supported by the support ledges 122*a* and 122*b*. During the above process, the batch completely leaves the elevator 129.

After that, when the elevator 129 rises to the same level as that of the support ledges 122*a* and 122*b*, the support ledges 122*a* and 122*b* withdraw and the stack 150*a*, which has been on the support ledges 122*a* and 122*b*, is received by the elevator 129. During this movement, the press bar 138 is accommodated in the ledge 136 and the ledge 136 and the press bar 138 together rise and move forward to return to the state of FIG. 10(*a*). This procedural cycle is repeated until a required number of batches are ejected.

According to the above counter ejector, partly since the ejecting conveyor 140 is disposed sufficiently close to the pusher 124, thereby allowing to handle boxes having a possible minimum size and partly since the upper conveyer 144 can adjust its position in synchronization with the front stop 126, the stroke of the pusher 124 can be shortened, so that a required operation time can be reduced. Since the support ledges 122*a* and 122*b*, instead of the ledge 136, temporarily support the stack 150 and the ledge 136 can start the evacuation immediately after the press bar 138 finishes the function of depressing the stack 150, a required operation time can be reduced. In addition, since air pressure from the blower 132 depresses the top surface of the stack 150, such reduction in required operation time can largely reduce the cycle time.

PRIOR ART REFERENCE

Patent Literature

[Patent Literature 1] Japanese Laid-Open Publication No. 2008-149730

BRIEF SUMMARY OF THE INVENTION

Problems to be Solved by Invention

It has been discovered that the technique of Patent Literature 1 enhances the operation speed of a box former, but increase in operation speed has a possibility of a case where corrugate board boxes are not properly piled.

This means that, in order to enhance the operation speed of the machine, each individual corrugated board box 103 needs to fall faster, as illustrated in FIG. 11(*a*), by increasing the air pressure AP downwardly applied from the blower, which is disposed above a position close to the exit of the forwarding rolls 102.

Unfortunately, it has been discovered that high air pressure AP from the blower bends the corrugated board box 103 ejected from the exit of the forwarding rolls 102 forward to a state where the forward end (in the moving direction) of the corrugated board box 103 drops, which results in that; as illustrated in FIG. 11(*b*), the forward end of the corrugated board box 103 collides with the top surface of the stack below and the corrugated board box 103 is piled on the stack 150 in a forward-bent posture; and as illustrated in FIG. 11(*c*), the forward end of a succeeding corrugated board box 103A slips beneath the antecedent corrugated board box 103.

In a case of piling a corrugated board box 103 of bad posture like above, the machine is forced to stop and the productivity is largely declined. For the above, the operation speed needs to be restricted so as not to cause such cases, hindering high-speed operation of the machine.

It has also been discovered that this problem does not arise if a corrugated board box is small in size along the transfer direction, but does arise if a corrugated board box is large in size along the transfer direction.

The cause of the problem is considered that: a corrugated board box which is large in size along the transfer direction bends to be convex upward by lowering the forward end due to its weight while the corrugated board box is transferred to a portion over the hopper, being sandwiched by the forwarding rolls, and when the corrugated board box receives large downward air pressure near its base supported by the forwarding rolls, the corrugated board box bends downward at a portion close to the base to remarkably lower its forward end.

In view of the foregoing problems, the object of the present invention is to provide a counter ejector that allows corrugated board boxes to rapidly fall into the hopper in a proper posture, and a box former including the above counter ejector.

Means to Solve the Problems

To attain the above object, as a first generic feature, the counter ejector of the present invention is disposed at a downstream part of a box former and includes: a hopper that receives a sheet-shaped corrugated board box being transferred and forwarded from an upstream side from underneath; and a blower that downwardly blows air to the hopper from above the corrugated board box, wherein the blower is capable of changing a blowing area to be blown along a transfer direction of the corrugated board box, and blows air to the blowing area corresponding to at least the front-end portion and the rear-end portion of the hopper in the transfer direction if the corrugated board box has a possible maximum size in the transfer direction.

As a preferable feature, the blower may be configured to blow a variable amount of air (amount of air per unit area, i.e., air speed or air pressure) to each of segments of the blowing area, and include a controller that changes the blowing area or the amount of air to be blown by the blower.

As another preferable feature, the controller may change the blowing area or the amount of air to be blown in the transfer direction in accordance with a size of the corrugated board box in the transfer direction.

As an additional preferable feature, the controller may change the blowing area or the amount of air to be blown in the transfer direction in accordance with a size in the width direction of the corrugated board box.

As a further preferable feature, the blower may be capable of changing a blowing area to be blown in a width direction of the corrugated board box; and the controller may change the blowing area or the amount of air to be blown in the transfer direction in accordance with a size of the corrugated board box in at least one of the transfer direction and the width direction.

As a still further preferable feature, the controller may change the blowing area or the amount of air to be blown in accordance with an operation speed of the box former.

As a still further preferable feature, the controller may change the blowing area or the amount of air to be blown on the basis of the material, the weight, and the flute of the corrugated board box.

As a still further preferable feature, the blower may include a fixed blower fixed to a position corresponding to the rear-end portion of the hopper in the transfer direction and a movable blower being movable at the front-end portion of the hopper in the transfer direction in accordance with a size of the corrugated board box.

As a still further preferable feature, the blower may include a plurality of segments divided in the transfer direction or the width direction of the corrugated board box, and a plurality of shutter mechanisms, provided one for each of the plurality of segments, that open and close openings of the plurality of segments, wherein the blowing area is variable by the plurality of shutter mechanisms.

As a still further preferable feature, the blower may include a plurality of fans being arranged in the transfer direction or a width direction of the corrugated board box and functioning independently of one another; and the blower may selectively activate the plurality of fans so that the blowing area can be changed.

According to a second generic feature, there is provided a box former including: a feed section that feeds a corrugated board sheet one at a time; a print section that prints on the corrugated board sheet fed from the feed section; a slotter creaser section that ejects the corrugated board sheet printed in the print section; a die cutting section that die-cuts the corrugated board sheet ejected from the slotter creaser section; a folder gluer section that applies glue to an end of the corrugated board sheet processed by the die cutting section and folds to thereby form a sheet-shaped corrugated board box; and a counter ejector section that counts and piles the corrugated board box processed by the folder gluer section, wherein the counter ejector section includes a blower that is capable of changing a blowing area to be blown along a transfer direction of the corrugated board box, and blows air to the blowing area corresponding to at least the front-end portion and the rear-end portion of the hopper in the transfer direction if the corrugated board box has a possible maximum size in the transfer direction.

Effects of Invention

The counter ejector and the box former of the present invention include a blower that downwardly blows air to the hopper from above the corrugated board box and the blower is capable of changing the blowing area in at least the transfer direction of the corrugated board box. With this configuration, even if the corrugated board box is large in size, that is, has a large area to receive the blown air, widening the blowing area without increasing an amount of air (i.e., air speed or air pressure) increases the total force that the entire top surface of the corrugated board box receives from the blown air. This makes it possible to let the corrugated board box fall rapidly into the hopper, preventing the posture of the corrugated board box from being inclined. Thereby, the operation speed of the box former can be enhanced.

The blower, which is configured to blow a variable amount of air to each of segments of the blowing area, makes it possible to properly correct the posture and the behavior of the corrugated board box when the box is falling into the hopper.

In particular, by changing the blowing area or the amount of air to be blown in the transfer direction in accordance with the size in the transfer direction of the corrugated board box, the posture and the behavior of the corrugated board box when the box is falling into the hopper can be properly adjusted in accordance with the size along the transfer direction. Besides, by changing the blowing area or the amount of air to be blown in the transfer direction in accordance with the size in the width direction of the corrugated board box, the posture and the behavior of the corrugated board box when the box is falling into the hopper can be properly adjusted in accordance with the size along the width direction.

When the blower is capable of changing the blowing area to be blown in the width direction, setting the blowing area and the amount of air to be blown in accordance with the sizes in the transfer direction and the width direction of the corrugated board box makes it possible to adjust the posture and the behavior of the corrugated board box when the box is falling into the hopper.

Changing the blowing area or the amount of air to be blown in accordance with an operation speed of the box former makes it possible to enhance the operation speed while adjusting the posture and the behavior of the corrugated board box when the box is falling into the hopper.

Although the posture and the behavior of the corrugated board box falling into the hopper change depending on the material, the weight, and the flute of the corrugated board box, changing the blowing area and the amount of air to be blown makes it possible to correct the posture and behavior of the corrugated board box in accordance with the material, the weight, and the flute of the corrugated board box.

The blower, which includes: a fixed blower fixed to a position corresponding to the rear-end portion of the hopper in the transfer direction; and a movable blower being movable at the front-end portion of the hopper in the transfer direction in accordance with the size of the corrugated board box, makes it possible to blow air to both the front- and the rear-end portions of the corrugated board box in the transfer direction and also to correct the change in posture and behavior of the corrugated board box in accordance with the transfer direction.

By including a plurality of segments divided in the transfer direction or the width direction of the corrugated board box, and a plurality of shutter mechanisms, provided one for each of the plurality of segments, that open and close openings of the plurality of segments, the blower can vary the blowing area using the plurality of shutter mechanisms, so that the blowing area can be set further in detail.

The blowing area can be easily changed by the blower, which includes a plurality of fans being arranged in the transfer direction or the width direction of the corrugated board box and functioning independently of one another and which can vary the blowing area by selectively activating the plurality of fans.

BRIEF DESCRIPTION OF THE SEVERAL VIEWS OF THE DRAWINGS

FIG. 1(*a*) is a top view; and FIG. 1(*b*) is a side view;

FIG. 8(*a*) is a top view; and FIG. 8(*b*) is a side view;

FIG. 9(*a*) is a top view; and FIG. 9(*b*) is a side view;

FIG. 11(*a*) illustrates a state where a sheet-shaped corrugated board box is being forwarded from forwarding rolls; FIGS. 11(*b*) and 11(*c*) illustrate states after a sheet-shaped corrugated board box is ejected from forwarding rolls.

DESCRIPTION OF REFERENCE NUMBERS

Figure 1A:
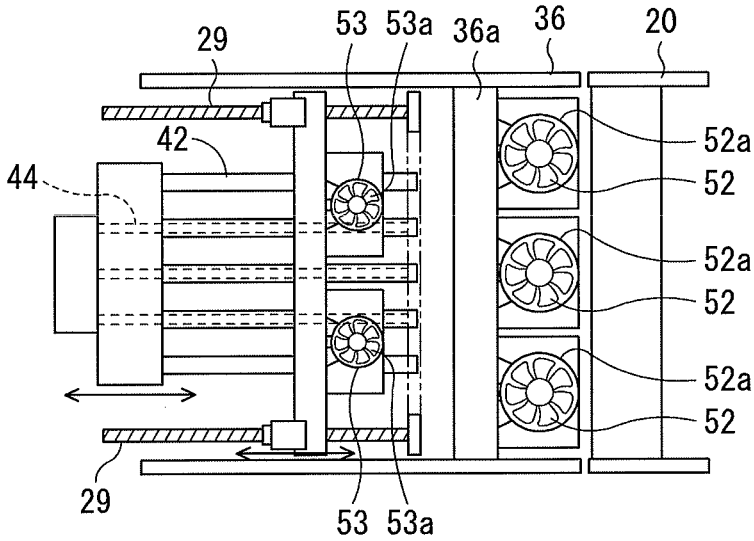
FIGS. 1(*a*) and 1(*b*) are schematic diagrams illustrating the main part of a counter ejector according to a first embodiment.

1 feed section
2 print section

3 slotter creaser section
4 die cutting section
5 folder gluer section
6 counter ejector section (counter ejector)
10,10$_1$,10$_2$,10$_n$ sheet-shaped corrugated board box (sheet to be formed into a box)
10*a* corrugated board sheet
20 frame
21 conveyor roller
22 forwarding roll
23 spanker
24 rotating lever
25*a*,25*b* support ledge
26 air cylinder
27 pusher
28 front stop
29 screw axis
31 air cylinder
32 elevator
33*a* rack
33*b* pinion
34 supporting axis
35 servomotor
36 side frame
37 rail
38 ledge supporter
39 roller
40 forwarding/reversing ledge servomotor
41 lift mechanism
42 ledge
43 servomotor for raising/lowering ledge
44 press bar
45 lift mechanism
46 servomotor for raising/lowering press bar
47 lower conveyer
47*a* servomotor for lower conveyor
48 ejecting conveyer
48*a* servomotor for ejecting conveyor
49 upper conveyor
49*a*,49*b* moving mechanism
50,50*a* stack
51 photoelectric tube (detector means)
52,55 fixed fan (fixed blower)
53 movable fan (movable blower)
54 controller
56 blower
57 blower motor
58 driveline (a combination of belt and pulley, or a combination of chain and sprocket)
59 blower duct
60*a*,60*b* bulkhead
61*a*~61*c*,62 shutter
100 batch sheet
H space (hopper section)

DETAILED DESCRIPTION OF THE INVENTION

Hereinafter, embodiments of the present invention will now be described with reference to the accompanying drawings.

Figure 1B:
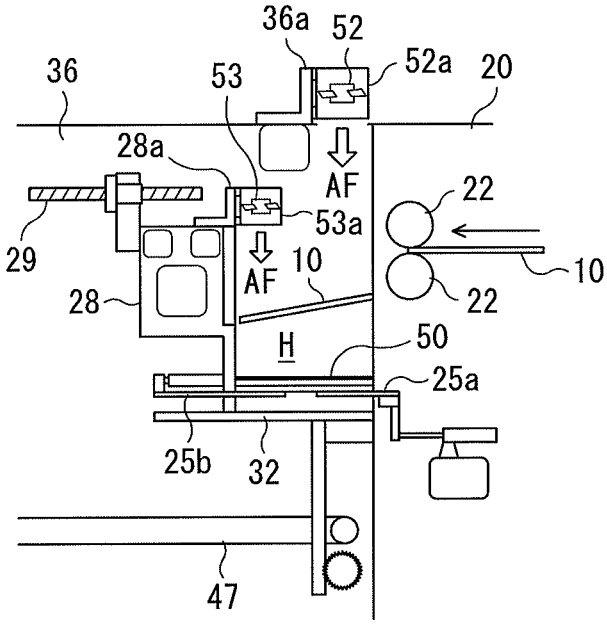
Figure 2:
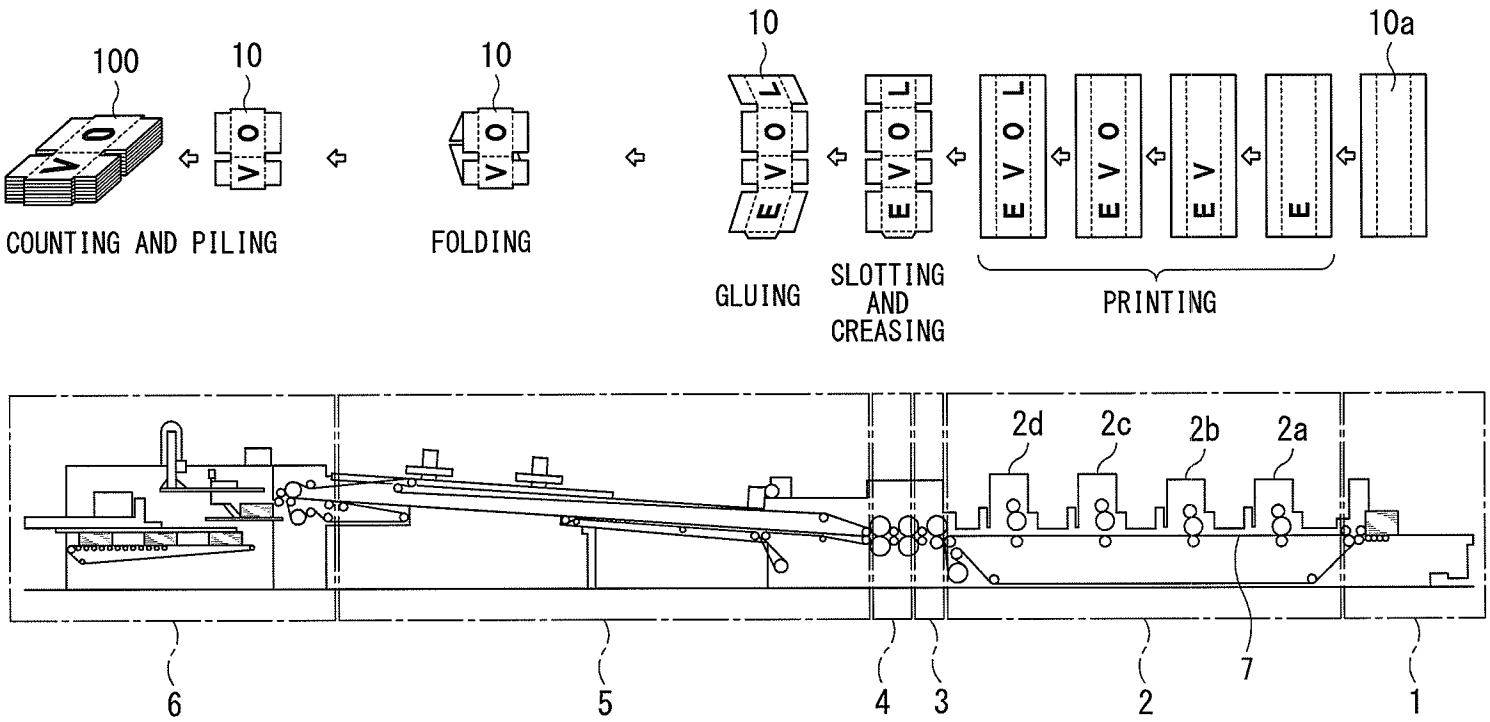
FIG. 2 is a side view depicting a box former equipped with a counter ejector of embodiments of the present invention.
Figure 3:
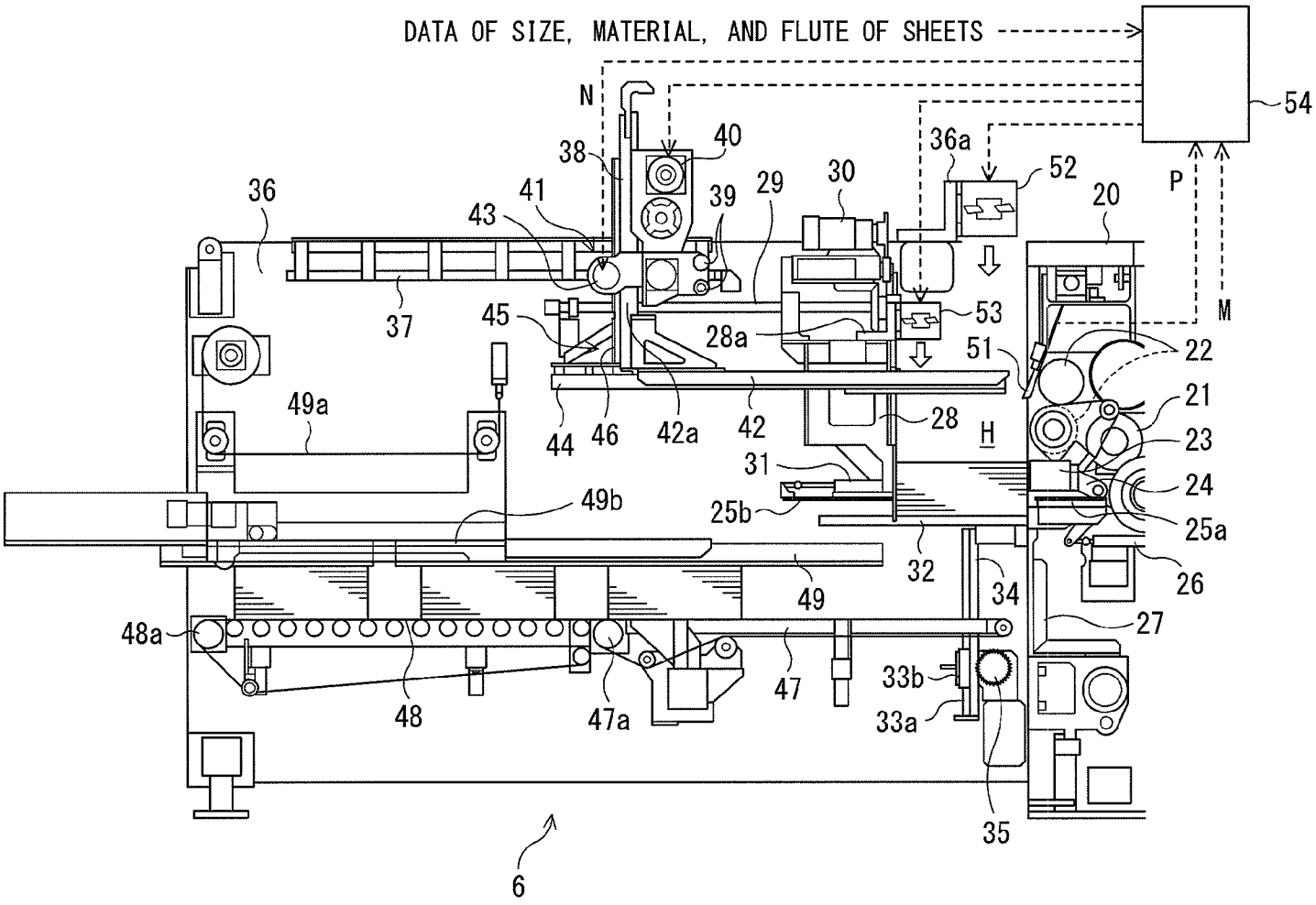
FIG. 3 is a side view depicting the entire structure of a counter ejector of the first embodiment (omitting frames disposed frontward of the drawing and illustrating the inside of the counter ejector)
Figure 7A:
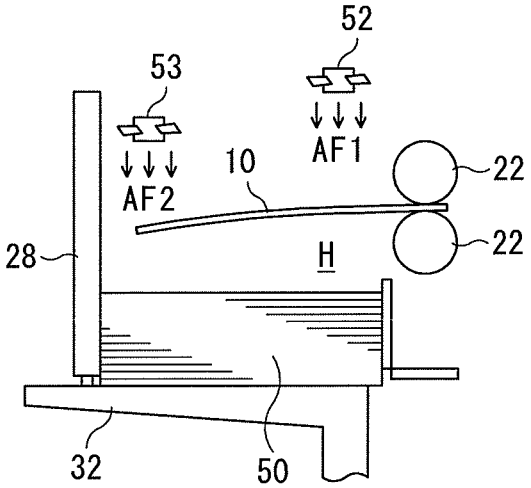
FIGS. 7(*a*), 7(*b*), and 7(*c*) are schematic diagrams denoting effects of a counter ejector of the first embodiment.
Figure 7B:
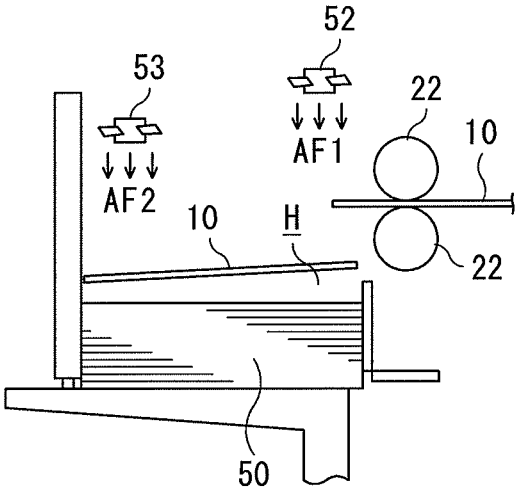
Figure 7C:
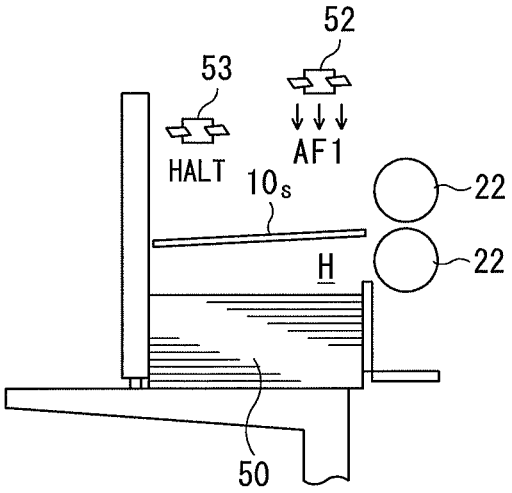
Figure 8A:
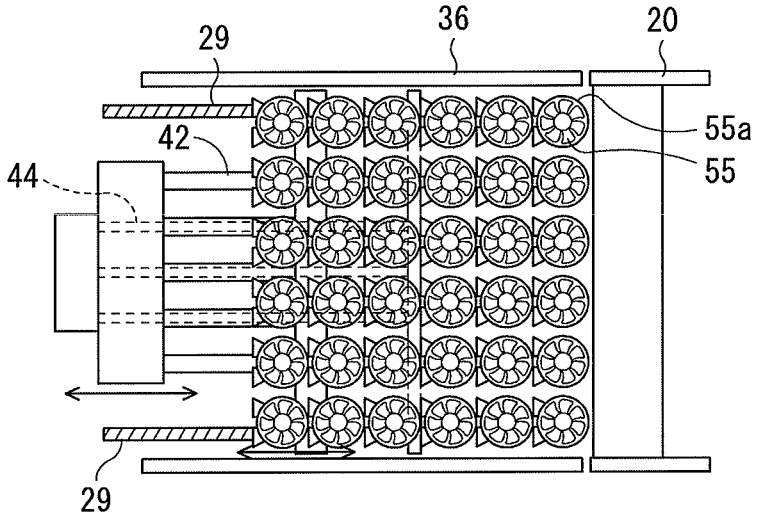
FIGS. 8(*a*) and 8(*b*) are schematic diagrams illustrating the main part of a counter ejector according to a second embodiment.
Figure 8B:
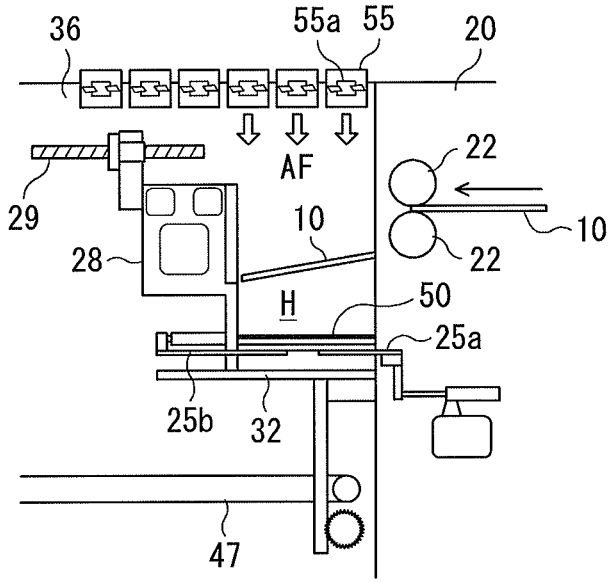

FIGS. 1(*a*), 1(*b*), through FIGS. 7(*a*)-7(*c*) illustrate a counter ejector according to a first embodiment of the present invention; FIGS. 8(*a*) and 8(*b*) illustrate a counter ejector according to a second embodiment; and FIGS. 9(*a*) and 9(*b*) illustrate a counter ejector according to a third embodiment. FIGS. 2 and 3 are also used for referring to the second and the third embodiments in addition to the first embodiment.

First Embodiment

To begin with, description will now be made in relation to the configuration of a box former including a counter ejector according to the first embodiment.

FIG. 2 illustrates the procedural steps of processing a corrugated board sheet into a sheet-shaped corrugated board box (sheet to be formed into a box) on the upper part separately from the machine configuration of the box former below. As illustrated in FIG. 2, the box former includes from the upstream side, a feed section 1, a print section 2, a slotter creaser section 3, a die cutting section 4, a folder gluer section 5, and a counter ejector 6.

A pile of multiple corrugated board sheets 10*a* is conveyed into the feed section 1, which feeds (supplies) each individual corrugated board sheet 10*a* to the print section 2. The print section 2 includes a predetermined number (here, four) of printing units 2*a*-2*d* for the respective colors and sequentially prints the respective color inks on a corrugated board sheet 10*a* being conveyed individually by a transfer conveyer 7.

The slotter creaser section 3 ejects the corrugated board sheets 10*a* underwent printing by the print section 2, and the next die cutting section 4 die-cuts the corrugated board sheets 10*a*. In succession, the folder gluer section 5 applies glue to tabs on the left or right ends of the corrugated board sheets 10*a* underwent the slotting and creasing and then folds the corrugated board sheets 10*a* such that the left ends and the right ends of the corrugated board sheets 10*a* overlap on the backsides (at the bottom). Namely, the folder gluer section 5 binds the left and right ends of the corrugated board sheets 10*a* with glue into sheet-shaped corrugated board boxes 10 (sheets to be formed into boxes).

The counter ejector 6 counts sheet-shaped corrugated board boxes 10 processed in the folder gluer section 5 and piles the boxes 10 onto a table (stacker table). When a predetermined number of sheet-shaped corrugated board boxes 10 are piled, the sheet group 100 is regarded as a batch unit and is shipped.

Next, the counter ejector 6 (i.e., the counter ejector of the first embodiment) will now be described with reference to FIG. 3.

As illustrated in FIG. 3, frames 20 are vertically arranged on the both ends on the width direction at the entrance of the counter ejector 6(*a*) conveyer roller 21 disposed at the exit (the rearmost position) of the folder gluer section 5 and a pair of forwarding rolls 22 vertically arranged are mounted on the frames 20. A spanker 23 that depresses the edge of a stack (a pile of multiple sheet-shaped corrugated board boxes 10) 50 that is to be detailed below is disposed at a lower portion of the forwarding rolls 22. The spanker 23 is coupled to a rotating lever 24 and is configured to move forward and backward due to rotation of the rotating lever 24.

The space below the exit of the forwarding rolls 22 serves as a space (hopper) H where the sheet-shaped corrugated board boxes 10 are piled into the stack 50.

A support ledge 25(*a*) is attached to the bottom of the spanker 23 and is allowed to go into and out of the hopper H by an air cylinder 26. Furthermore, a pusher 27 that pushes the stack 50 is disposed under the support ledge 25(*a*) and is allowed to go into and out of the hopper H by an non-illustrated actuator such as an air cylinder.

A front stop 28 that stops sheet-shaped corrugated board boxes 10 ejected from the folder gluer 5 is disposed ahead of the forwarding rolls 22 so as to face the forwarding rolls 22. The front stop 28 is supported to be movable in forward and backward directions. In detail, the upper portion of the front stop 28 is attached to a screw axis 29 that extends in the machine direction. Rotation of the screw axis 29 in response to the rotation of the motor 30 moves the front stop 28 forward and backward. Another support ledge 25*b* is disposed at the bottom of the front stop 28 so as to go into and out of the hopper H by an cylinder 31. The support ledges 25*a* and 25*b* face each other and cooperatively receive the stack 50 on a ledge 42 to be detailed below.

An elevator 32 is disposed below the front stop 28, so that the sheet-shaped corrugated board boxes 10 which hit the front stop 28 and fall are received and piled as the stack 50 on the elevator 32. The elevator 32 is substantially horizontally arranged slightly ahead of the forwarding rolls 22 and is supported by a supporting axis 34 installing a rack 33*a* thereon. The elevator 32 is configured to be vertically movable by a driving mechanism including the rack 33*a*, a pinion 33*b* that engages with the rack 33*a*, and a servomotor 35 coupled to the pinion 33*b*.

Side frames 36 are disposed downstream of the hopper H on the both ends of the width direction of the counter ejector 6. The side frames 36 include rails 37 horizontally extended. The rails 37 slidably support a ledge supporter 38. Namely, rollers 39 that travel on the rails 37, a non-illustrated pinion engaging with a non-illustrated rack arranged along the rails 37, and a forwarding/reversing ledge servomotor 40 that rotates the pinion are provided on the ledge supporter 38. Forward and reverse rotation of the forwarding/reversing ledge servomotor 40 moves the ledge supporter 38 in the forward and backward directions.

A ledge 42 that horizontally extends is provided on the ledge supporter 38, being interposed by a lift mechanism 41. The lift mechanism 41 includes a non-illustrated rack and pinion mechanism, and a servomotor for raising/lowering ledge 43 that rotates the pinion. The forward and reverse rotation of the servomotor 43 raises and lowers the ledge supporter 38. The ledge 42 is disposed for the purpose of being activated when the number of the sheet-shaped corrugated board boxes 10 piled as the stack 50 reaches a predetermined number and receiving the sheet-shaped corrugated board boxes 10 to be piled as the next stack 50*a*. A press bar 44 that depresses the stack 50 is provided on a vertical member 42*a* of the ledge 42, being supported by a lift mechanism 45 so as to rise and lower. The lift mechanism 45 includes a non-illustrated rack and pinion mechanism, and a non-illustrated servomotor for raising/lowering press bar 46 that rotates the pinion. Forward and reverse rotation of the servomotor 46 rises and lowers the press bar 44.

A lower conveyer 47 is disposed on the same level as the top surface of the elevator 32 when being in the lowest position, and an ejecting conveyer 48 is disposed downstream of the lower conveyer 47 on the same level as the lower conveyer 47. The lower conveyer 47 and the ejecting conveyer 48 are driven by a servomotor 47*a* and a servomotor 48*a*, respectively. The upstream end of the lower conveyer 47 is disposed inward of the elevator 32 so that the lower conveyer 47 is near enough to the pusher 27 to receive a sheet-shaped corrugated board box 10 minimum in length (along the traveling direction).

An upper conveyor 49 that sandwiches the stack 50 together with the lower conveyer 47 and the ejecting conveyer 48 is disposed over the lower conveyer 47 and the ejecting conveyer 48 via a moving mechanism 49*a*, and the height of the upper conveyor 49 is adjustable. The upper conveyor 49 is also movable in the forward and backward directions by a moving mechanism 49*b*, and is configured to move in conjunction with the front stop 28 to a predetermined distance from the front stop 28 so as to fit the size of the sheet-shaped corrugated board box 10.

As one of the characteristic features of the counter ejector 6 of the first embodiment, fans (blowers) 52 and 53 that blow air AF onto the top surface of the sheet-shaped corrugated board box 10, which is forwarded from the forwarding rolls 22, are disposed over the elevator 32. The fan 52 is a fixed fan (fixed blower) which is fixed to a beam 36*a* supported by the side frames 36 whereas the fan 53 is a movable fan (movable blower) which is fixed to a beam 28*a* supported by the front stop 28 and which moves in the forward and backward directions along with the front stop 28. The fans 52 and 53 will be detailed below.

A photoelectric tube (detector means) 51 that detects the passage of a sheet-shaped corrugated board box 10 is disposed on the traveling path of the sheet in the counter ejector 6. The photoelectric tube 51 is electrically coupled to a controller (controller means, control device) 54 and transmits a passage signal P indicating detection of passage of a sheet to the controller 54.

Data M representing the operation speed v (i.e., the rotating speed of the forwarding roll 22) at the time is transmitted to the controller 54 along with the passage signal P of the sheet-shaped corrugated board box 10, and the controller 54 calculates the time for the sheet-shaped corrugated board box 10 to reach the front stop 28 using the received data M and signal P, and transmits a signal (lowering signal) N that activates the ledge 42 to the servomotor for raising/lowering ledge 43. For example, the controller 54 is configured to transmit a lowering signal N to the servomotor for raising/lowering ledge 43 after a time represented by $\Delta T=S/v$ has passed since the controller 54 received a passage signal P of the sheet-shaped corrugated board box 10, where a symbol S represents the distance between the photoelectric tube 51 and the front stop 28, and the symbol v represents the operation speed.

Here, the fans (blowers) 52 and 53 will now be detailed with reference to FIGS. 1(*a*) and 1(*b*).

As illustrated in FIGS. 1(*a*) and 1(*b*), multiple (here, three) fixed fans 52 are fixed to the beam 36*a* supported by the side frames 36 and are arranged in the width direction of the sheet-shaped corrugated board box 10. In contrast, multiple (here, two) movable fans 53 are fixed to the beam 28*a* supported by the front stop 28 and are arranged in the width direction of the sheet-shaped corrugated board box 10. Namely, the fixed fans 52 are arranged at a position corresponding to the rear-end portion of the hopper H along the transfer direction while the movable fans 53 are arranged at a position corresponding to the front-end portion of the hopper H along the transfer direction.

In the illustrated example, the fixed fans 52 are arranged near to the top of the side frames 36, at a much higher level than the level of the exit of the forwarding rolls 22. In contrast, the movable fans 53 are arranged near to the front stop 28, also at a higher level than the level of the exit of the forwarding rolls 22 but at a position relatively near to the exit.

Accordingly, the large distance between the sheet-shaped corrugated board box 10 and the fixed fans 52 arranged over the rear-end portion in the transfer direction lowers the air speed but widens the affected blowing area, so that the fixed fans 52 can blow air onto almost the entire surface of the sheet-shaped corrugated board box 10 without the aid of the movable fans 53 unless the sheet-shaped corrugated board box 10 is excessively large in size in the transfer direction. In contrast, the movable fans 53 arranged at the position corresponding to the front-end portion in the transfer direction, which are closer to the sheet-shaped corrugated board box 10, partially blow strong air to the front portion of the sheet-shaped corrugated board box 10, and can be efficiently used when sufficient air is not blown solely by the fixed fans 52. Besides, since the movable fans 53 are ultimately fixed to the front stop 28, the movable fans 53 are automatically adjusted so as to blow air to the front end of the sheet-shaped corrugated board box 10 irrespective the length of the sheet.

Each of the fans 52 and 53 blows air along the downward vertical direction, that is, a direction perpendicular to near horizontal direction in which a sheet-shaped corrugated board box 10 is properly forwarded from the forwarding rolls 22. The fans 52 and 53 are surrounded independently of one another by ducts 52*a* and 53*a*, which rectify the air blown by the respective fans 52 and 53 to the downward vertical direction.

Besides, the fans 52 and 53 are controlled independently of one another by the controller 54. Specifically, various data pieces such as the sizes (in both the transfer direction and the width direction), the material, the weight, and the flute of the sheet-shaped corrugated board box 10 are previously input into the controller 54, and the operation speed data of the box former is input into the controller 54. The controller 54 controls activation and halt of the respective fans 52 and 53 and the amount of air (amount of air per unit area, which is correlated with air speed and/or air pressure) during the activation using the above data pieces.

Specifically, a higher operation speed of the box former and a larger top-view area of the sheet-shaped corrugated board box 10 require faster fall of the sheet-shaped corrugated board box 10. For this purpose, the amount of air blown to the sheet-shaped corrugated board box 10 in the downward vertical direction (i.e., an amount of air blown to the entire sheet-shaped corrugated board box 10) needs to be large. However, when a strong blow (a large amount of blow per unit area, i.e., high air-speed blow) is locally applied to the sheet-shaped corrugated board box 10, the sheet-shaped corrugated board box 10 deforms and improperly behaves to fall in an improper posture.

Such deformation and behavior of the sheet-shaped corrugated board box 10 depend not only on the operation speed of the box former and the top-view area of the sheet-shaped corrugated board box 10 but also on the weight and the stiffness of the sheet-shaped corrugated board box 10. The weight and the stiffness of the sheet-shaped corrugated board box 10 are determined in terms of the material, the weight of the sheet-shaped corrugated board box 10, and a flute of the precursor corrugated board sheet. In this example, using these pieces of data, an optimum blowing area and an optimum amount of blow in each blowing area for the sheet-shaped corrugated board box 10 to be manufactured are acquired from test carried out in advance and are formed into a database. The controller 54 determines an optimum blowing area and an optimum amount of blow in each blowing area from the input data pieces with reference to the database and controls the fans 52 and 53 accordingly.

Figure 4A:
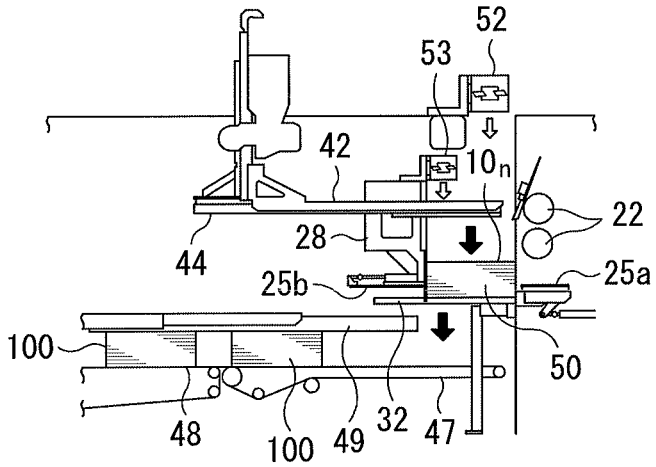
FIGS. 4(*a*), 4(*b*), and 4(*c*) are schematic side views illustrating the movements in sequence of FIGS. 4(*a*), 4(*b*), and 4(*c*) in a counter ejector of the first embodiment.
Figure 4B:
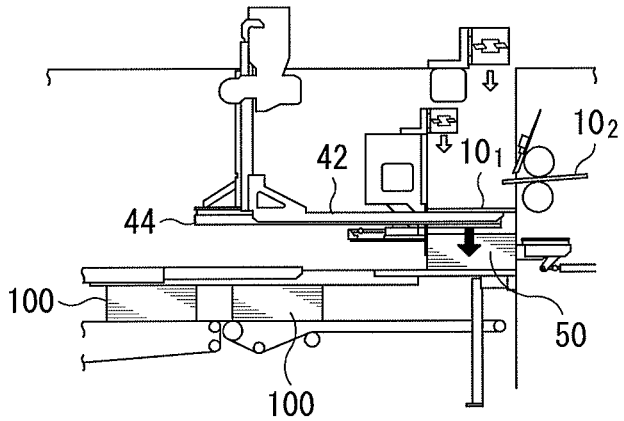
Figure 4C:
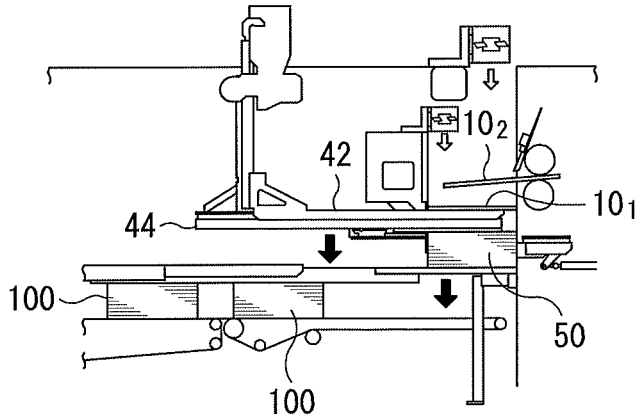

Next, description will now be made in relation to operation of the counter ejector 6 of the first embodiment with reference to FIGS. 4(*a*)-4(*c*), 5(*a*)-5(*c*), and 6(*a*)-6(*b*). FIGS. 4(*a*)-6(*b*) use reference numbers $\mathbf{10}_1$, $\mathbf{10}_2$, and $\mathbf{10}_n$ to discriminate the respective sheet-shaped corrugated board boxes 10 from one another.

FIG. 4(*a*) illustrates the counter ejector 6 immediately after the number of the sheet-shaped corrugated board boxes 10 piled as the stack 50 on the elevator 32 reaches the predetermined number. At the time the last sheet-shaped corrugated board box 10 to be piled into the stack 50 hits the front stop 28, the ledge 42 and the press bar 44 incorporated in the ledge 42 fall and, as illustrated in FIG. 4(*b*), receive a sheet-shaped corrugated board box $\mathbf{10}_1$ that is the first sheet to be piled into the next stack 50*a*. The instruction of the controller 54 to lower the ledge 42 is output based on a calculation of the time that takes for the last sheet-shaped corrugated board box $\mathbf{10}_n$ (e.g. the 100-th sheet) to reach the front stop 28 from the position of the photoelectric tube 51 using the passage signal P representing the reach of the front edge of the last sheet-shaped corrugated board box $\mathbf{10}_n$ detected by the photoelectric tube 51 and the data M representing the operation speed at the time, and is transmitted to the lift mechanism 41.

Figure 5A:
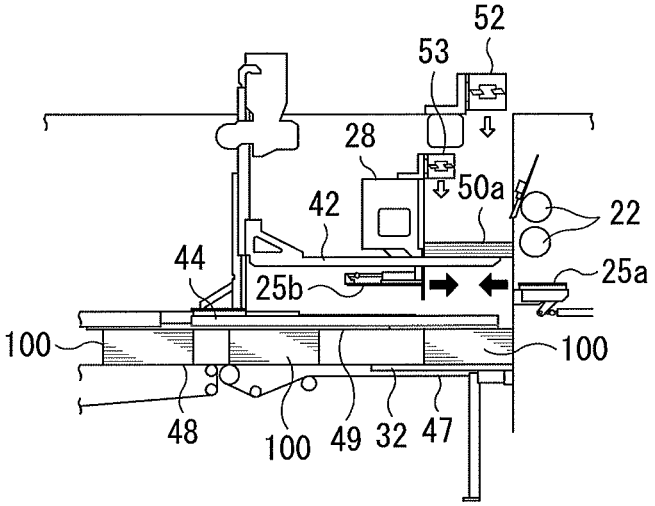
FIGS. 5(*a*), 5(*b*), and 5(*c*) are schematic side views illustrating the movements in sequence of FIGS. 5(*a*), 5(*b*), and 5(*c*) in a counter ejector of the first embodiment.
Figure 5B:
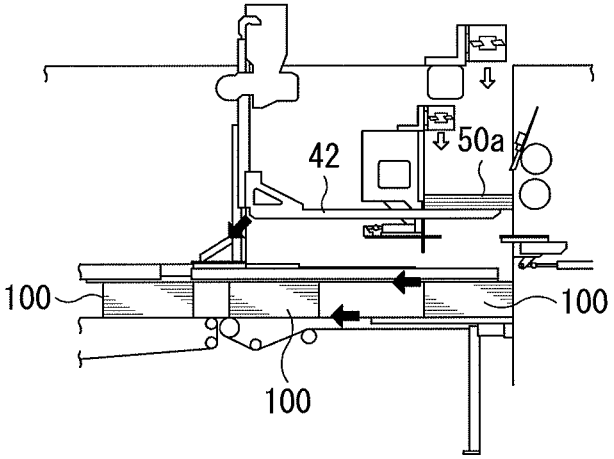
Figure 5C:
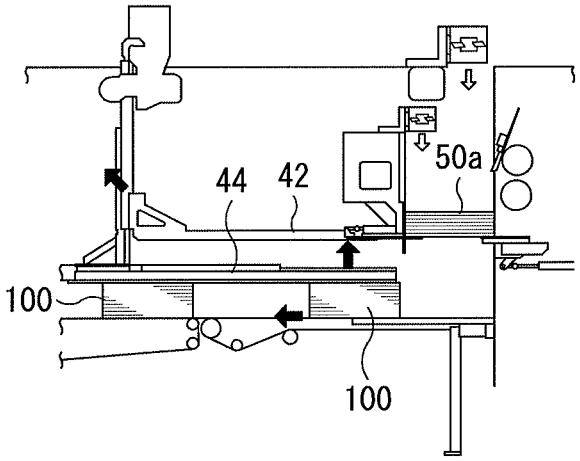

FIG. 4(*c*) illustrates the elevator 32 lowered to the same level as that of the lower conveyer 47. At the time depicted in FIG. 4(*b*), when the ledge 42 sequentially receives the sheet-shaped corrugated board boxes $\mathbf{10}_1$ and $\mathbf{10}_2$ that are to be piled as the next stack 50*a*, the elevator 32 immediately starts lowering to the same level as that of the lower conveyer 47. In order to prevent the stack 50 from collapsing due to spring back, the press bar 44 is pressed down to a lower level than that of the ledge 42 and falls, sandwiching the stack 50 in cooperation with the elevator 32. Then when the top surface of the stack 50 passes the support ledges 25*a* and 25*b*, the support ledges 25*a* and 25*b* stick out to face each other as depicted in FIG. 5(*a*) and come into the stand-by state as depicted in FIG. 5(*b*). On the ledge 42, a next stack 50*a* is being formed.

In the state illustrated in FIG. 5(*b*), the pusher 27, which does not however appear in the drawing, pushes the stack 50 until the stack 50 is sandwiched by the upper conveyor 49. After that, the stack 50 pushed by the pusher 27 is brought out as a batch 100 by the lower conveyer 47, the ejecting conveyer 48 and the upper conveyor 49.

As illustrated in FIG. 5(*c*), when the batch 100 starts moving by the lower conveyer 47 and the ejecting conveyer 48, the press bar 44 slightly rises to leave the top surface of the batch 100. The ledge 42 evacuates together with the press bar 44 in such a position that the ledge 42 does not interfere with the stack 50*a* to wait for the next rise. At this time, the stack 50*a* on the ledge 42 is supported by the support ledges 25*a* and 25*b*. During the above process, the batch 100 completely departs from the elevator 32.

Figure 6A:
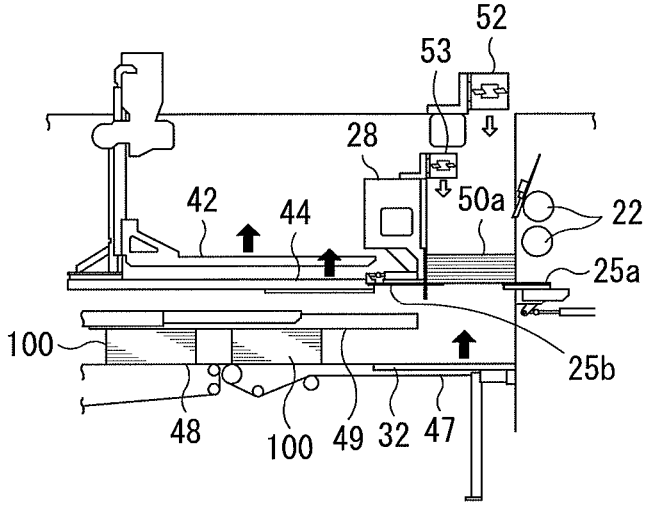
FIGS. 6(*a*) and 6(*b*) are schematic side views illustrating the movements in sequence of FIGS. 6(*a*) and 6(*b*) in a counter ejector of the first embodiment.
Figure 6B:
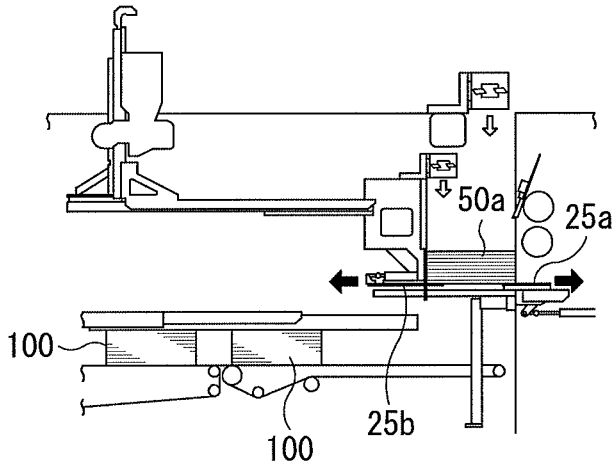

As illustrated in FIG. 6(*a*), when the batch 100 departs from the elevator 32, the elevator 32 rises to the same level as the support ledges 25*a* and 25*b*. In succession, the support ledges 25*a* and 25*b* are retracted, and the stack 50*a* that has been on the support ledges 25*a* and 25*b* is taken over by the elevator 32. At the same time, the press bar 44 is accommodated to the ledge 42 and, as illustrated in FIG. 6(*b*), the ledge 42 rises together with the press bar 44. When the ledge 42 reaches the same level as the state of FIG. 4(*a*), the ledge 42 moves forward to the position shown in FIG. 4(*a*). This cycle is repeated until a required number of batches 100 are brought out.

The counter ejector 6 of the first embodiment has the configuration and functions as detailed in the above. In the operation of the counter ejector 6, the controller 54 adjusts the activation and halt (adjustment on the blowing area) of the respective fans 52 and 53 and the amount of air (amount of air per unit area, which is correlated with the air speed and/or air pressure) during the activation to the respective optimum states on the basis of the sizes (sizes in the transfer direction and the width direction), the material, the weight, and the flute of the sheet-shaped corrugated board box 10, and data of operation speed of the machine. Thereby, the sheet-shaped corrugated board box 10 can rapidly fall into the hopper H, keeping the proper posture and behavior.

This enhances the high-speed operation of the box former.

For example, as illustrated n FIG. 7(*a*), if a sheet-shaped corrugated board box 10 has a large size in the transfer direction, the movable fans 53 disposed at the front-end portion in the transfer direction are activated to apply an air flow AF2 in addition to an air flow AF1 applied by the fixed fans 52 disposed at the rear-end portion in the transfer direction. This makes it possible to apply a sufficient air flow (AF1+AF2) to the entire sheet-shaped corrugated board box 10, preventing the air flow AF1 from the fixed fans 52 from being excessively strong. Thereby, as illustrated in FIG. 7(*b*), the sheet-shaped corrugated board box 10 can rapidly fall, without causing improper posture and behavior of the sheet-shaped corrugated board box 10 due to an excessively strong air flow AF1.

Conversely, if the sheet-shaped corrugated board box 10 does not have the large size in the transfer direction, a strong air flow AF1 hardly causes improper posture and behavior of the sheet-shaped corrugated board box 10. For the above, as illustrated in FIG. 7(*c*), the sheet-shaped corrugated board box 10 can fall rapidly and efficiently without causing the improper posture and behavior as the movable fans 53 at the front-end portion are brought to a halt and only the air flow AF1 from the fixed fans 52 at the rear-end portion is applied with strength conforming to the size of the sheet-shaped corrugated board box 10 and the operation speed of the box former.

The controller 54 controls the respective fans 52 and 53 based on the database so as to optimize the blowing area and the amount of air in each blowing area for the sheet-shaped corrugated boas d box 10 to be manufactured on the basis of the sizes (sizes in the transfer direction and the width direction), the material, the weight, and the flute of the sheet-shaped corrugated board box 10, and data of operation speed of the machine. Thereby, the sheet-shaped corrugated board box 10 can rapidly fall, even under various types of corrugated board sheets 10 or various operation conditions of the machine, avoiding improper posture and behavior of the sheet-shaped corrugated board box 10.

As an example of controlling the fans 52 and 53 of the first embodiment, an amount of air from the fixed fans 52 is set to be a constant value so as not to cause the sheet-shaped corrugated board box 10 to have improper posture and behavior and a lacking amount of air from the fans 52 is supplemented by air from the movable fans 53, so that the controlling can be accomplished by a simple logic. It is preferable that the supplemented amount of air from the movable fans 53 is controlled to be the lacking amount of air.

If the sheet-shaped corrugated board box 10 deforms (warps) in the width direction, adjusting the blowing area and an amount of air to be blown both in the width direction can inhibit the warp.

Normally, the sheet-shaped corrugated board box 10 is transferred with matching the direction (flute direction) in which the flute extends to the transfer direction. If a special sheet-shaped corrugated board box 10 may sometimes be transferred in the direction perpendicular to the flute direction, the sheet-shaped corrugated board box 10 tends to have a warp large in the transfer direction, so that more detailed setting of the blowing area and the amount of air is preferable. However, the above problem can be solved by, for example, increasing the numbers of fans 52 and 53.

Enhancement in operation speed of the box former requires the counter ejector 6 to properly pile sheet-shaped corrugated board boxes 10 without suppressing the operation speed of the machine. According to the counter ejector 6 of the first embodiment, it is possible for the sheet-shaped corrugated board box 10 to rapidly fall into the hopper H, keeping the proper posture of the sheet-shaped corrugated board box 10, so that the sheet-shaped corrugated board boxes 10 can be properly piled in the hopper H while the machine is operating at a high speed. Application of the counter ejector 6 of the first embodiment to a box former allows the box former to rapidly operate.

Second Embodiment

Next, description will now be made in relation to a counter ejector according to a second embodiment of the present invention with reference to FIGS. 8(*a*) and 8(*b*). Like reference numbers in FIGS. 8(*a*) and 8(*b*) designate the similar parts and elements of the first embodiment, so repetitious description will be omitted here.

The second embodiment is different only in blower from the first embodiment.

As illustrated in FIGS. 8(*a*) and 8(*b*), the blower includes a large number of fixed fans 55 supported by the side frames 36 and arranged in transfer direction and the width direction, and the controller 54 controls the activation and halt (adjustment of the blowing area) of the respective fans 55 and the amount of air (amount of air per unit area, which is correlated with the air speed and/or air pressure) during the activation to accomplish the respective optimum states on the basis of the sizes (sizes in the transfer direction and the width direction), the material, the weight, and the flute of the sheet-shaped corrugated board box 10, and data of operation speed of the machine.

Here, the fixed fans 55 are arranged in a matrix of six in the transfer direction and six in the width direction. Each fixed fan 55 is arranged so as to blow air in the downward vertical direction and is surrounded by a duct 55*a*. The blown air from each fixed fan 55 is rectified by the dud 55*d* such that the blown air is directed to the downward vertical direction.

Similarly to the first embodiment, this configuration can let the sheet-shaped corrugated board box 10 to fall rapidly into the hopper H, keeping the proper posture and behavior of the sheet-shaped corrugated board box 10 Thereby, the operation speed of the box former can be enhanced.

In the second embodiment, many fixed fan 55 arranged in matrix can set the blowing area and amount of blowing air in detail.

Third Embodiment

Next, description will now be made in relation to a counter ejector according to a third embodiment of the present invention with reference to FIGS. 9(*a*) and 9(*b*). Like reference numbers in FIGS. 9(*a*) and 9(*b*) designate the similar parts and elements of the first and the second embodiments, so repetitious description will be omitted here.

The third embodiment is different only in blower from the first and the second embodiments.

Figure 9A:
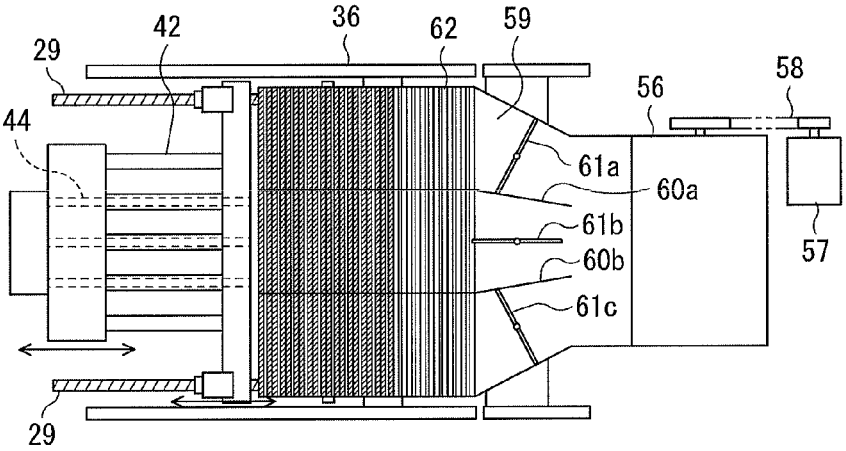
FIGS. 9(*a*) and 9(*b*) are schematic diagrams illustrating the main part of a counter ejector according to a third embodiment.
Figure 9B:
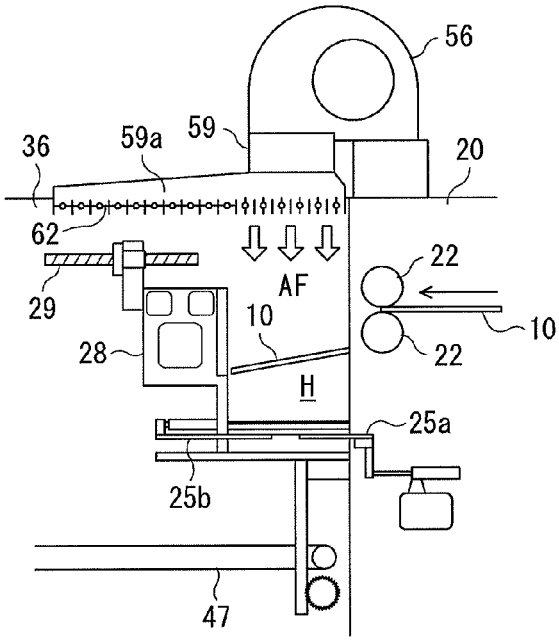
Figure 10A:
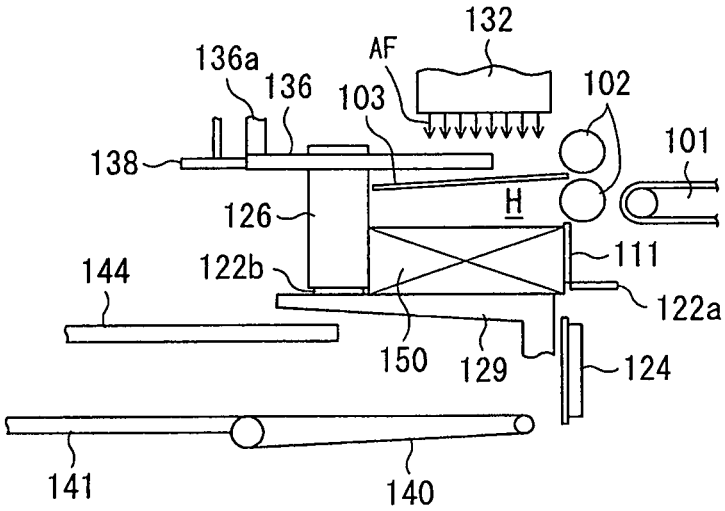
FIG. 10(a) Prior Art
FIGS. 10(*a*), 10(*b*), and 10(*c*) are schematic side views illustrating the movements in sequence of FIGS. 10(*a*), 10(*b*), and 10(*c*) in a counter ejector related to a background technique.
Figure 10B:
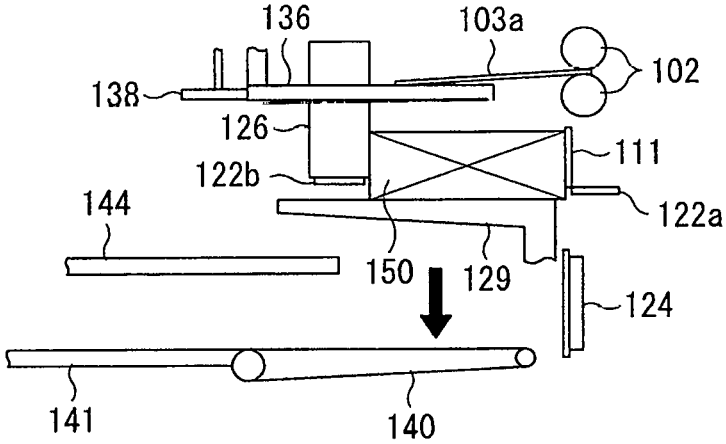
FIG. 10(b) Prior Art
Figure 10C:
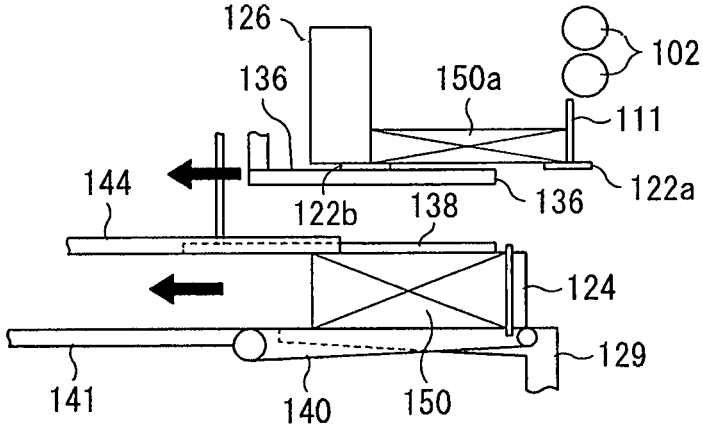
FIG. 10(c) Prior Art
Figure 11:
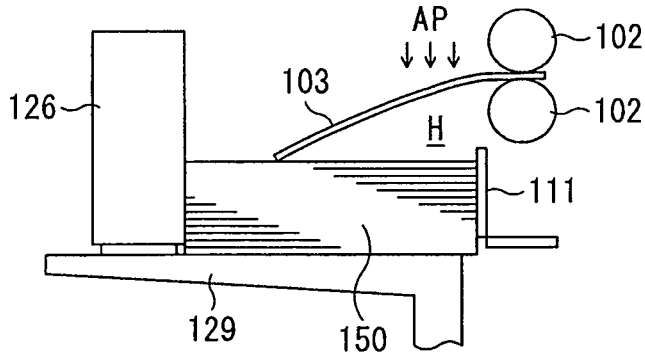
FIG. 11 (a) Prior Art
FIGS. 11(*a*), 11(*b*), and 11(*b*) are schematic side views denoting problems of a counter ejector of a background technique.
Figure 11:
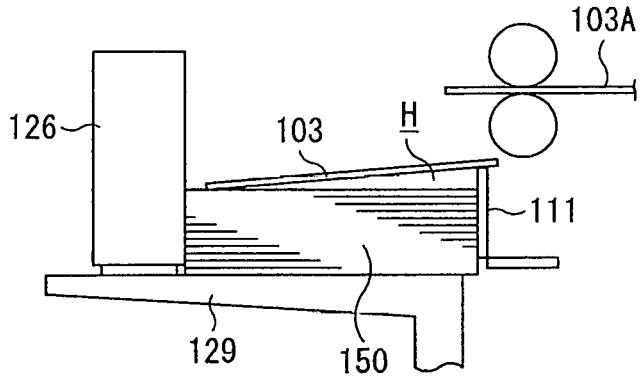
FIG. 11 (b) Prior Art
Figure 11:
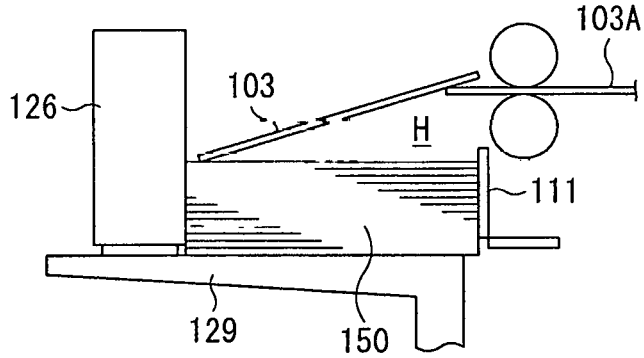
FIG. 11 (c) Prior Art

As illustrated in FIGS. 9(*a*) and 9(*b*), the blower includes a blower 56, a blower motor 57 that rotates the blower 56, a driveline (a combination of a belt and a pulley or a combination of a chain and sprocket) that transmits driving force of the blower motor 57 to the blower 56, and a blower duct 59.

The blower duct 59 is segmented into multiple (here, three) flow paths in the width direction by bulkheads 60*a* and 60*b*. Shutters 61*a*-61*c* are arranged at the entrances of the respective flow paths and are independently of one another opened and closed so as to let the air from the blower 56 flow to the downstream side or to shut off.

Furthermore, multiple shutters 62 are arranged along the width direction at the exit of the blower duct 59 and are opened and closed independently of one another.

The blower motor 57 and the shutters 61*a*-61*c* and 62 are each controlled by the controller 54. Namely, the controller 54 adjusts the blowing area by opening and closing the respective shutters 61*a*-61*c* and 62 and the amount of air (amount of air per unit area, which is correlated with the air speed and/or air pressure) by controlling the blower motor 57 to the respective optimum states on the basis of the sizes (sizes in the transfer direction and the width direction), the material, the weight, and the flute of the sheet-shaped corrugated board box 10, and data of operation speed of the machine.

In this example, when the shutters 62 disposed at the exit of the blower duct 59 are opened, the shutters 62 are directed vertically to guide the blown air in the direction vertically downward.

Similarly to the first and the second embodiments, this configuration can let the sheet-shaped corrugated board box 10 fall rapidly into the hopper H, keeping the proper posture and behavior of the sheet-shaped corrugated board box 10. Thereby, high-speed operation of the box former can be enhanced.

Many shutters 62 of this embodiment also make it possible to set blowing area and amount of blowing air in detail.

Embodiments of the present invention are described as above, but the present invention should by no means be limited to the foregoing embodiments. Various modification, omission, and combination can be suggested without departing from the gist of the present invention.

Namely, the blower of the present invention can change blowing area at least in the transfer direction of a corrugated board box, and for a corrugated board box having the possible maximum size in the transfer direction, sufficiently has blowing area corresponding at least to the front-end and the rear-end portions of the hopper. The blower of the present invention is not limited to those of the first through the third embodiments if satisfying the above conditions.

The specific configurations of each part of the counter ejector and the box former of the first to the third embodiments are of course only examples, and can be changed and modified without departing from the spirit of the present invention.

INDUSTRIAL APPLICABILITY

The present invention is to be applied to a box former that manufactures a sheet-shaped corrugated board box, and in particular applied to a box former that manufactures sheet-shaped corrugated board boxes having various different sizes in the transfer direction. Consequently, sheet-shaped corrugated board box of any size can more rapidly fall into the hopper, keeping proper posture.

The invention claimed is:

1. A counter ejector disposed at a downstream part of a box former, the counter ejector comprising:

a hopper that receives a sheet-shaped corrugated board box being transferred and forwarded from an upstream side from underneath; and a blower that downwardly blows air to the hopper from above the corrugated board box, wherein the blower is changing a blowing area to be blown along a transfer direction of the corrugated board box, and blows air to the blowing area corresponding to at least a front-end portion and a rear-end portion of the hopper in the transfer direction if the corrugated board box has a possible maximum size in the transfer direction, wherein the blower comprises a fixed blower fixed to a position corresponding to the rear-end portion of the hopper in the transfer direction and a movable blower being movable at the front-end portion of the hopper in the transfer direction in accordance with a size of the corrugated board box, and the movable blower is fixed to a front stop which is supported to be movable in forward and backward directions and stops the corrugated board box, and the movable blower moves in the forward and backward directions along with the front stop.

2. The counter ejector according to claim 1, wherein the blower blows a variable amount of air to each of segments of the blowing area, and comprises a controller that changes the blowing area or the amount of air to be blown by the blower.

3. The counter ejector according to claim 2, wherein the controller changes the blowing area or the amount of air to be blown in the transfer direction in accordance with the size of the corrugated board box in the transfer direction.

4. The counter ejector according to claim 3, wherein the blower is changing the blowing area to be blown in a width direction of the corrugated board box; and the controller changes the blowing area or the amount of air to be blown in the width direction in accordance with the size of the corrugated board box in at least one of the transfer direction and the width direction.

5. The counter ejector according to claim 3, wherein the blower comprises a plurality of segments divided in the transfer direction or a width direction of the corrugated board box, and a plurality of shutter mechanisms, provided one for each of the plurality of segments, that open and close openings of the plurality of segments, wherein the blowing area is variable by the plurality of shutter mechanisms.

6. The counter ejector according to claim 3, wherein the blower comprises a plurality of fans being arranged in the transfer direction or a width direction of the corrugated board box and functioning independently of one another; and the blower selectively activates the plurality of fans so that the blowing area can be changed.

7. The counter ejector according to claim 2, wherein the controller changes the blowing area or the amount of air to be blown in the transfer direction in accordance with the size in a width direction of the corrugated board box.

8. The counter ejector according to claim 7, wherein the blower comprises a plurality of segments divided in the transfer direction or the width direction of the corrugated board box, and a plurality of shutter mechanisms, provided one for each of the plurality of segments, that open and close openings of the plurality of segments, wherein the blowing area is variable by the plurality of shutter mechanisms.

9. The counter ejector according to claim 7, wherein the blower comprises a plurality of fans being arranged in the transfer direction or the width direction of the corrugated board box and functioning independently of one another; and the blower selectively activates the plurality of fans so that the blowing area can be changed.

10. The counter ejector according to claim 2, wherein the controller changes the blowing area or the amount of air to be blown in accordance with an operation speed of the box former.

11. The counter ejector according to claim 2, wherein the controller changes the blowing area or the amount of air to be blown on a basis of a material, a weight, and a flute of the corrugated board box.

12. The counter ejector according to claim 2, wherein the blower comprises a plurality of segments divided in the transfer direction or a width direction of the corrugated board box, and a plurality of shutter mechanisms, provided one for each of the plurality of segments, that open and close openings of the plurality of segments, wherein the blowing area is variable by the plurality of shutter mechanisms.

13. The counter ejector according to claim 2, wherein the blower comprises a plurality of fans being arranged in the transfer direction or a width direction of the corrugated board box and functioning independently of one another; and the blower selectively activates the plurality of fans so that the blowing area can be changed.

14. The counter ejector according to claim 1, wherein the blower comprises a plurality of segments divided in the transfer direction or a width direction of the corrugated board box, and a plurality of shutter mechanisms, provided one for each of the plurality of segments, that opens and closes openings of the plurality of segments, wherein the blowing area is variable by the plurality of shutter mechanisms.

15. The counter ejector according to claim 1, wherein the blower comprises a plurality of fans being arranged in the transfer direction or a width direction of the corrugated board box and functioning independently of one another; and the blower selectively activates the plurality of fans so that the blowing area can be changed.

16. The counter ejector according to claim 1, wherein the movable blower is arranged at a lower level than a level of the fixed blower.

* * * * *